US005862761A

United States Patent [19]

Moore

[11] Patent Number: 5,862,761

[45] Date of Patent: Jan. 26, 1999

[54] SCAMP AND HOUSING THEREFOR

[75] Inventor: Lorraine Moore, Cameron, Tex.

[73] Assignee: Balt, Inc., Cameron, Tex.

[21] Appl. No.: 914,745

[22] Filed: Aug. 19, 1997

[51] Int. Cl.[6] ..... A47F 5/12; A47B 57/00

[52] U.S. Cl. ..... 108/92; 108/10; 108/50.01; 108/9

[58] Field of Search ..... 108/6, 9, 10, 50.01, 108/92; 248/291.1, 299.1, 188.91, 454

[56] References Cited

U.S. PATENT DOCUMENTS

| | | | |
|---|---|---|---|
| 2,722,287 | 11/1955 | Beinhorn | 108/92 |
| 2,973,603 | 3/1961 | Vincenzo | 108/9 |
| 4,428,631 | 1/1984 | Cope et al. | 108/6 X |
| 5,078,414 | 1/1992 | Court et al. | 108/50.01 X |
| 5,174,223 | 12/1992 | Nagy et al. | 108/50.01 |
| 5,287,815 | 2/1994 | Gross | 108/50 |
| 5,461,974 | 10/1995 | Reneau | 108/50.01 X |
| 5,704,299 | 1/1998 | Corpuz, Jr. et al. | 108/50.01 |

FOREIGN PATENT DOCUMENTS

| | | | |
|---|---|---|---|
| 2235578 | 1/1975 | France | 108/10 |
| 127800 | 3/1950 | Sweden | 108/6 |
| 281701 | 3/1952 | Switzerland | 108/9 |

*Primary Examiner*—Peter M. Cuomo
*Assistant Examiner*—Hanh V. Tran
*Attorney, Agent, or Firm*—Wendy K. Buskop; Chamberlain, Hrdlicka et al.

[57] ABSTRACT

A scamp and a scamp housing with a scamp having a base with casters, a telescoping column attached to the base, a locking mechanism to secure the telescoping column at a predetermined height, a podium hingedly attached to column, and a locking mechanism to secure the podium at a predetermined attitude, and the scamp house being composed of two "U" shaped frames with a desktop attached to the top ends of the "U" frames, a shelf attached near the base of the "U" frames, a slot provided in the shelf to accommodate the column of the scamp such that the base of the scamp fits underneath the shelf and the podium of the scamp fits underneath the desktop.

1 Claim, 6 Drawing Sheets

SCAMP AND HOUSING THEREFOR

The present invention relates to office equipment. More particularly, the present invention relates to a sectionalized desk that can be separated and adjusted to fit the height and attitude requirements of a worker who is either sitting or standing.

BACKGROUND OF THE RELATED ART

For over one hundred years, since the invention of the typewriter, office furniture design remained relatively static. Typewriters were provided either with their own desks, or specially made attachments to existing desks. Now, however, with the proliferation of personal computers in the office, new elements are required in the standard suite of office equipment. The typewriter is gone. It has been replaced with a personal computer and its attendant peripherals. While this is a great advance in office automation, the ubiquitous personal computer has its drawbacks. Specifically, the personal computer requires attention to a monitor and input via a keyboard and mouse. The positioning of the keyboard vis-a-vis the monitor has become a major ergonomic concern within modern industry. The substantial increase in repetitive stress disorder and other office-related ailments has put a premium on proper positioning of the office equipment with respect to their users, who themselves come in a wide variety of shapes and sizes.

There is, therefor, a need in the art for office equipment that can be repositioned to conform to the ergonomic requirements of equipment users. It is an object of the present invention to solve the problem in the art by providing an office system that can accommodate a personal computer and its peripherals. It is a further object of the invention to provide an office system whereby the computer peripherals can be repositioned independently of each other to better fit the ergonomic needs of the user. It is a further object of the invention to provide an office system that does not require more office space than a standard desk.

SUMMARY OF THE INVENTION

The present invention solves the problems inherent in the prior art and meets the objects set forth. The present invention includes a scamp and a useful housing for the scamp. The scamp is provided with a base having at least three casters to ensure suitable maneuverability of the scamp over floors and carpets. A telescoping column is fixedly attached to the center of the base. A locking mechanism is provided to secure the telescoping column at a predetermined height. At the opposite end of the column from the base, a podium is attached by means of a hinge. The hinge allows the podium to be rotated with respect to the column. A locking mechanism is provided to secure the podium at a predetermined attitude.

The present invention also includes a house for the scamp. The scamp house is composed of two "U" shaped frames with a desktop attached to the top ends of the "U" frames. A shelf is attached near the base of the "U" frames to provide additional structural rigidity. A slot is provided in the shelf to accommodate the column of the scamp. The position of the shelf is such that the base of the scamp fits underneath the shelf and the podium of the scamp fits underneath the desktop. A back plate can be attached to the scamp house between the two "U" frames to increase structural rigidity. Office equipment, typically a personal computer and its attendant peripherals, can be placed on the scamp and the scamp house. For example, the keyboard and mouse can be placed on the scamp and the personal computer, monitor, and printer can be placed on the desktop and shelf of the scamp house. With this arrangement, the keyboard can be placed at varying distances, heights and attitudes with respect to the monitor, thereby enhancing the ergonomic capabilities of the scamp/scamp house system. By fitting the scamp within the scamp house, the space taken up for the storage of the present invention is less than that of an ordinary desk.

The foregoing and other advantages of the present invention will be apparent to those skilled in the art of office furniture in view of the accompanying drawings, description of the invention, and appended claims.

DETAILED DESCRIPTION OF THE PREFERRED EMBODIMENTS

Figure 8:
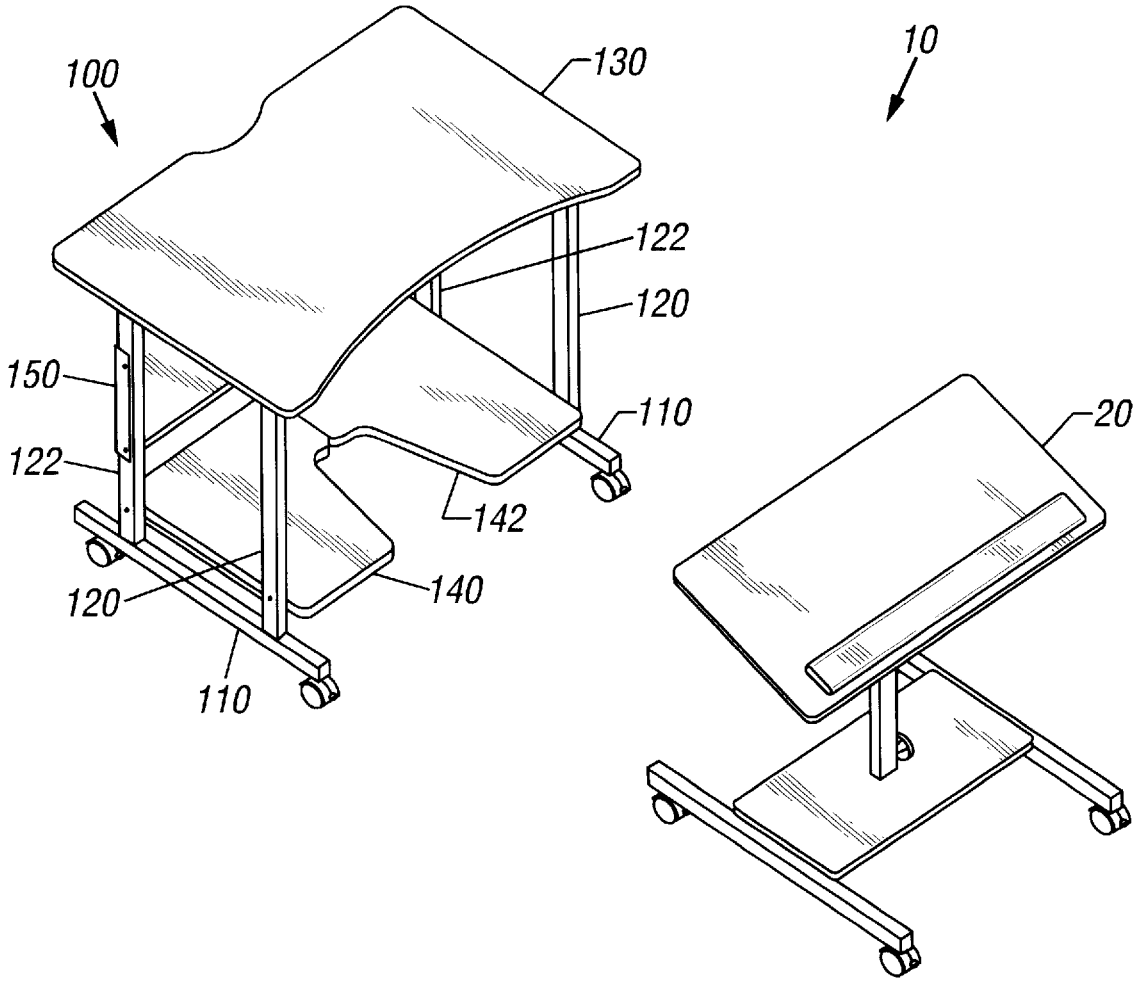
FIG. 8 shows a perspective view of the scamp in proximity to the scamp house of the present invention.

The present invention is a scamp system 10 that is composed of two main elements—the scamp 20 and the scamp house 100 as shown in FIG. 8.

Figure 1:
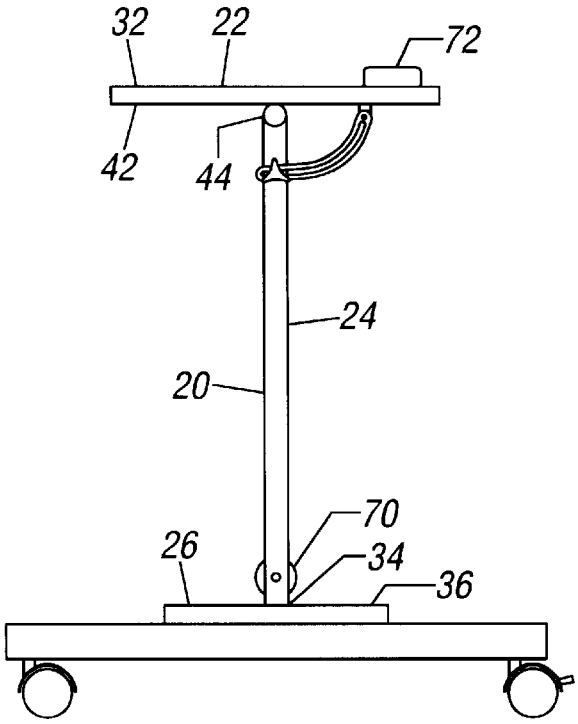
FIG. 1 shows a side view of a scamp of the present invention with the podium perpendicular to the column.
Figure 2:
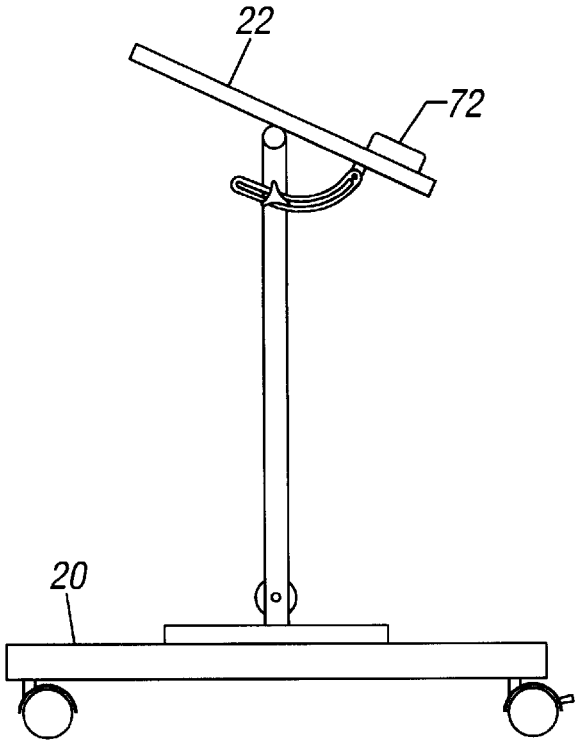
FIG. 2 shows a side view of a scamp of the present invention with the podium rotated with respect to the column.
Figure 3:
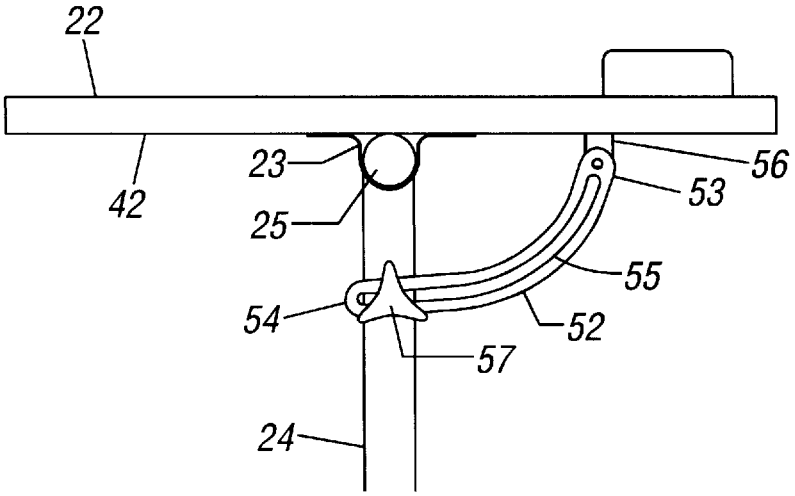
FIG. 3 shows a side view of the hinge on the scamp of the present invention.
Figure 4:
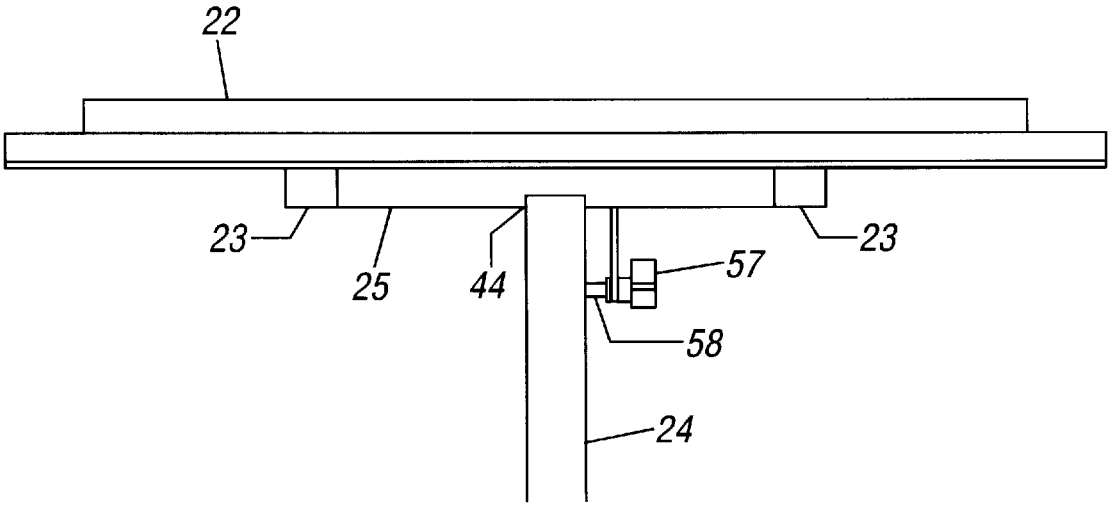
FIG. 4 shows a front view of the hinge on the scamp of the present invention.
Figure 5:
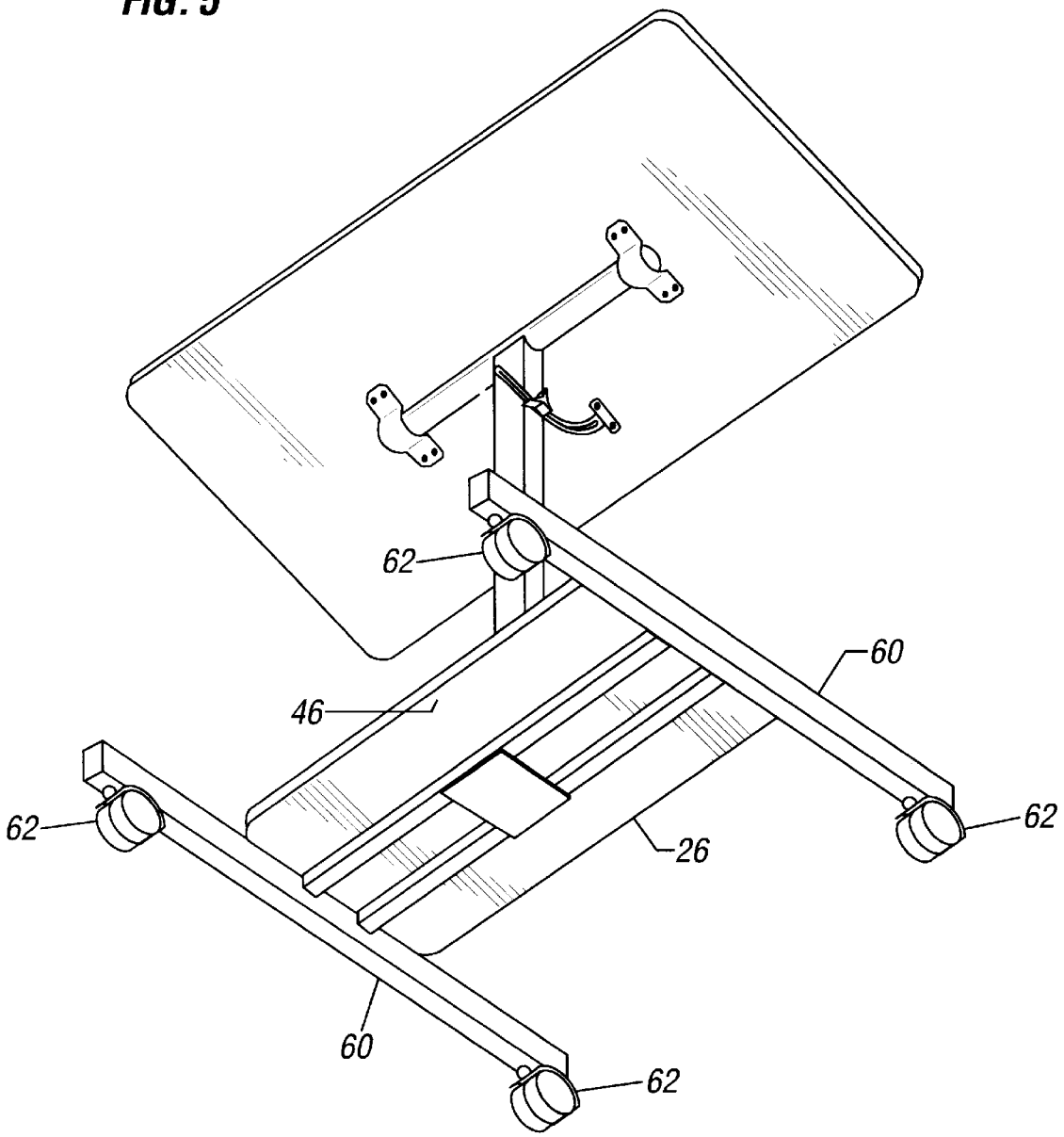
FIG. 5 shows a perspective view of the underside of the scamp of the present invention.

The scamp is shown in FIGS. 1–5. Referring to FIGS. 1 and 2, the scamp 20 has a base 26. The base has a top side 36 and a bottom side 46 as shown in FIGS. 1 and 5, respectively. The scamp 20 is also fitted with a column 24. The column has a first end 34 and a second end 44 as shown in FIG. 1. As shown in FIG. 1, the column 24 is attached at the first end 34 to the top side 36 of the base 26. In the preferred embodiment of the present invention, the column 24 is fitted perpendicular to the base 26. It will be understood by those of ordinary skill in the art that the columns 24 can be set to various angles with respect to the base 26 so long as the base 24 provides sufficient stability.

A podium 22 has a top side 32 and a bottom side 42 as shown in FIG. 1. As shown in FIG. 4, column 24 is fitted with a cross bar 25 at the second end 44. Two brackets 23 are fitted around the cross bar 25 and fastened to the bottom side 42 of the podium 22 in order to connect the column 24 to the podium 22. As shown in FIGS. 3 and 4, the brackets 23 in conjunction with the cross bar 25 form a hinge that enables the podium to be rotated with respect to the column to conform to a given task by the user.

To lock the podium at a pre-defined attitude (angle of rotation) vis-a-vis the column, a locking mechanism is provided. As shown in FIG. 3, the locking mechanism consists of a curved guide 52 that has a first end 53 and a second end 54. The guide 52 has a slot 55 that extends from the first end 53 to the second end 54. The first end 53 of the guide 52 is attached to the bottom side 42 of the podium 22 by means of a mounting bracket 56 as shown in FIG. 4. FIG. 3 shows the cam 58 that is attached to the column 24. The outer portion of the cam 58 is threaded and is fitted within the slot 55 of the guide 52. A knob 57 that contains a nut at its center is screwed onto the outer portion of cam 58. When the knob 57 is tightened, the knob is moved toward the column 24, eventually pressing the guide 52 against the cam 58 and locking the guide 52, and hence the podium 22 at a given attitude vis-a-vis the column 24. This locking mechanism allows a user to adjust the attitude of the podium with respect to the column. A pad 72 can be fitted along the bottom edge of the top side 32 of the podium 22 to prevent objects placed on the podium from falling when the podium is at a non-horizontal attitude.

The base 26 can be fitted with two beams 60 as shown in. Each beam can be fitted with a caster 62 at each end as shown in FIG. 5. The casters 62 enable the scamp to be maneuvered around the floor.

In the preferred embodiment of the present invention, the column 24 is telescoping. The telescoping feature of column 24 is of standard design, with a smaller diameter tube inserted within an outer diameter tube. The column knob 70 is used to lock, an a standard fashion, the telescoping column 24 at a given length corresponding to the desired height of the podium 22.

Figure 6:
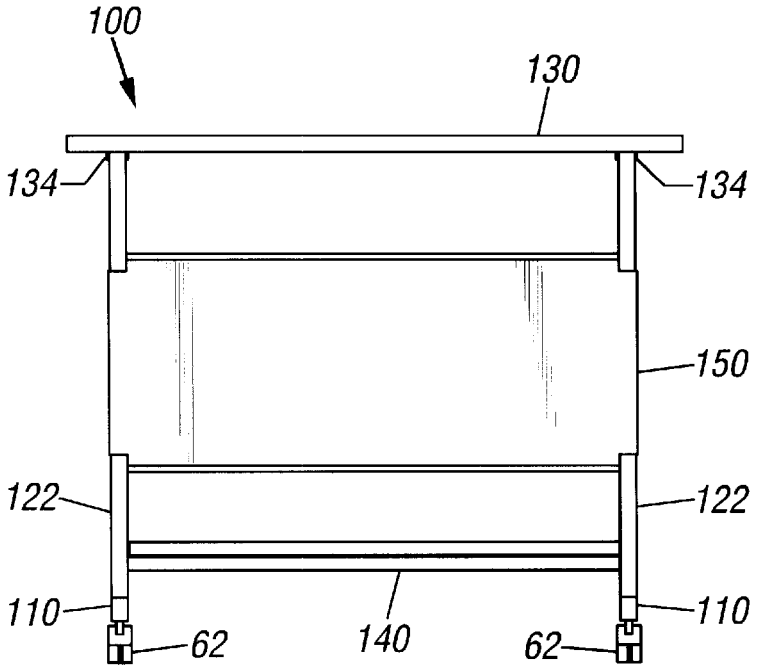
FIG. 6 shows a back view of the scamp house of the present invention.
Figure 7:
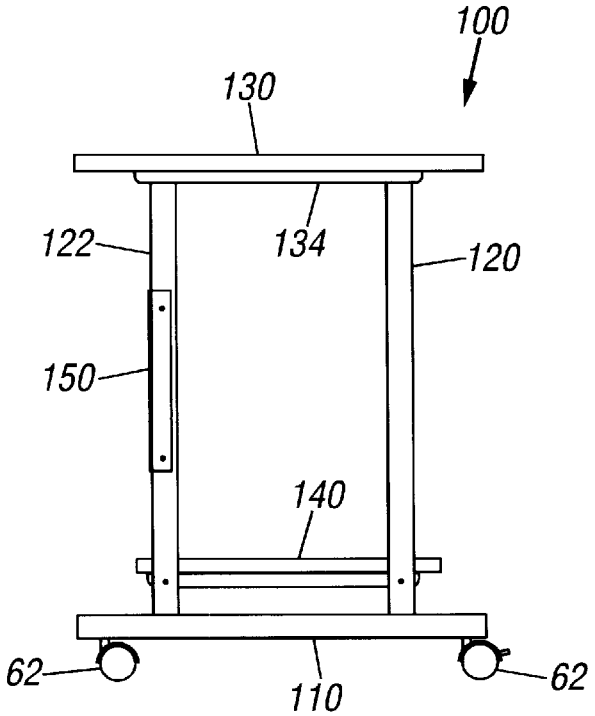
FIG. 7 shows a side view of the scamp house of the present invention.

A scamp house is provided that is used in conjunction with the scamp to form a scamp system 10. The scamp house 100 of the present invention is shown in FIGS. 6–10. The scamp house consist of a pair of beams 110 that have a pair of casters 62 fitted at each end as shown in FIGS. 6–8. The casters 60 enable the scamp house to be maneuvered around the floor.

As shown in FIG. 8, the top side of each beam is fitted with a front column 120 and a back column 122. The front column 120, the rear column 122, and the beam 110 for a "U" frame. At the top of the "U" frames, a desktop 130 is fitted as shown in FIG. 8. The bottom side 132 of the desktop 130 may be fitted with brackets 134 that are bolted to the top ends of the front column 120 and the rear column 122 as shown in FIGS. 6 and 7.

A shelf 140 is provided with the scamp house. The shelf 140 is positioned between the right "U" frame and the left "U" frame in near the bottom of each "U" frames as shown in FIGS. 6–8. The shelf 140 has a slot 142 that is used to accommodate the scamp 20 when the latter is fitted within the scamp house 100. To further increase structural integrity, the scamp house 100 can be fitted with a back plate 150 that fixedly attaches both rear columns 122 as shown in FIGS. 6–7.

Figure 9:
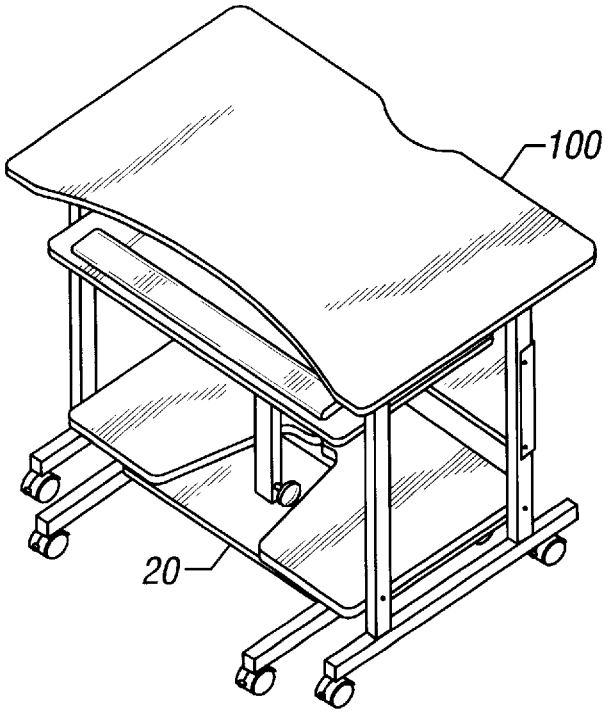
FIG. 9 shows a perspective view of the scamp within the scamp house of the present invention.
Figure 10:
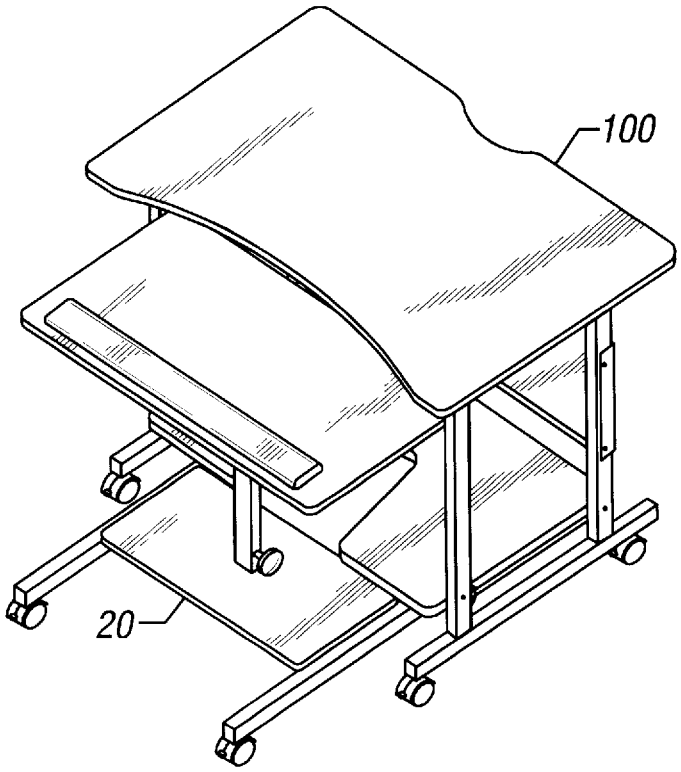
FIG. 10 shows a perspective view of the scamp in close proximity to the scamp house of the present invention.

The scamp 20 can be shortened and maneuvered to fit within the scamp house 100 as shown in FIGS. 9 and 10. In the preferred embodiment of the present invention, the base 26 of the scamp 20 fits under the shelf 140 of the scamp house 100. The column 24 if the scamp 20 fits within the slot 142 of the shelf 140 on the scamp house 100. The column 24 is shortened (telescoped) so that the podium 22 can fit underneath the desktop 130 of the scamp house 100. This procedure enables the scamp 20 to be stored within the scamp house 100 and reduce the floor space needed to store both items.

Finally, the above-discussion is intended to be merely illustrative of the invention. Numerous alternative embodiments may be devised by those having ordinary skill in the art without departing from the spirit and scope of the following claims.

What is claimed is:

1. A scamp and scamp house system comprising:

a scamp comprising:

a base, said base having a top side and a bottom side, a column, said column having a first end and a second end, said column attached to said top side of said base at said first end, said column protruding upward from said base, a podium, said podium having a top side and a bottom side, a hinge, said hinge attaching said bottom side of said podium to said second end of said column, said hinge constructed and arranged to enable said podium to be rotated with respect to said column, and locking means for preventing rotation of said podium when said locking means is locked and allowing rotation of said podium when said locking means is unlocked, wherein the attitude of said podium may be adjusted by a user to conform to a given task, and a scamp house comprising:

a left beam and a right beam, each of said beams having a top side and a bottom side, a pair of front columns, each of said front columns having a first end and a second end, each of said front columns is attached at said first end to said top side of each of said beams, a pair of rear columns, each of said rear columns having a first end and a second end, each of said rear columns is attached at said first end to said top side of each of said beams adjacent and parallel to said front column, said front column and said rear column of said left beam form a left "U" frame, said front column and said rear column of said right beam form a right "U" frame, a desktop, said desktop having a top side and a bottom side, said desktop further having a left edge and a right edge, said second ends of said left "U" frame are fixedly attached to said bottom side of said desktop along said left edge of said desktop, said second ends of said right "U" frame are fixedly attached to said bottom side of said desktop along said right edge of said desktop, said desktop and said frames form a house, and a shelf, said shelf having a left edge, a right edge and a front edge, said shelf positioned between said right "U" frame and said left "U" frame in proximity to said first ends of said columns, said left edge of said shelf is fixedly attached to said left "U" frame, said right edge of said shelf is fixedly attached to said right "U" frame, said shelf further having a slot on said front edge, said slot constructed and arranged to allow said scamp to fit within said house.

* * * * *